US007224248B2

(12) United States Patent
D'Ostilio

(10) Patent No.: US 7,224,248 B2
(45) Date of Patent: May 29, 2007

(54) CERAMIC LOADED TEMPERATURE COMPENSATING TUNABLE CAVITY FILTER

(76) Inventor: James P. D'Ostilio, 1604 Kemper St., Lynchburg, VA (US) 24501

( * ) Notice: Subject to any disclaimer, the term of this patent is extended or adjusted under 35 U.S.C. 154(b) by 0 days.

(21) Appl. No.: 10/911,574

(22) Filed: Aug. 5, 2004

(65) Prior Publication Data

US 2006/0038640 A1 Feb. 23, 2006

Related U.S. Application Data

(60) Provisional application No. 60/582,448, filed on Jun. 25, 2004.

(51) Int. Cl.
*H01P 7/04* (2006.01)
*H01P 7/06* (2006.01)
*H01P 7/00* (2006.01)

(52) U.S. Cl. ..... 333/223; 333/224; 333/226; 333/231; 333/234

(58) Field of Classification Search ..... 333/222, 333/223, 224, 226, 227, 229, 231, 234
See application file for complete search history.

(56) References Cited

U.S. PATENT DOCUMENTS 2,077,800 A 4/1937 Kroger
2,103,515 A 12/1937 Conklin, et al.
2,593,095 A * 4/1952 Brehm ..... 333/228
2,637,782 A 5/1953 Magnuski
2,998,582 A 8/1961 Riblet
3,160,825 A 12/1964 Derr
3,311,839 A * 3/1967 Rutulis ..... 330/4.9
3,348,173 A 10/1967 Matthaei et al.
3,448,412 A 6/1969 Johnson
3,534,301 A 10/1970 Golembeski
3,537,041 A 10/1970 Kommrusch
3,573,666 A * 4/1971 Caffrey et al. ..... 333/1.1
3,740,677 A 6/1973 Kommrusch
4,024,481 A 5/1977 Kivi
4,207,548 A 6/1980 Graham et al.
4,249,148 A 2/1981 Jachowski
4,292,610 A 9/1981 Makimoto et al.
4,389,624 A * 6/1983 Aihara et al. ..... 333/226

(Continued)

OTHER PUBLICATIONS

Designing Short High Q Resonators, Dale D. Henkes, ACS, Mlcrowaves & RF, Dec. 2003, 7 pages.

*Primary Examiner*—Robert Pascal
*Assistant Examiner*—Kimberly E Glenn
(74) *Attorney, Agent, or Firm*—Buchanan Ingersoll & Rooney PC

(57) ABSTRACT

A high Q RF cavity resonator loaded with a ceramic disc, the resonator comprising an inner conductive post having a length less than a quarter wavelength. The resonance frequency of the resonator is tunable by changing a distance between a) an outer plate and b) a ceramic disc and an end cap where the ceramic disc is located between the outer plate and the end cap. The resonance frequency can be tuned when the outer plate, ceramic disc, and end cap are in contact with each other by varying a pressure between the contact surfaces of the ceramic disc, the end cap and the outer plate. Temperature compensation allows the resonator to hold a resonance frequency despite changes in temperature, and can be achieved by selecting thermal coefficients of expansion of components holding or placing the ceramic disc and end cap relative to the outer plate.

24 Claims, 13 Drawing Sheets

U.S. PATENT DOCUMENTS 4,462,098 A 7/1984 D'Avello et al.
4,477,786 A 10/1984 Tamura et al.
4,721,932 A 1/1988 West
4,730,174 A * 3/1988 Nishikawa et al. ..... 333/224
4,794,354 A 12/1988 Dinsmore et al.
4,933,652 A 6/1990 Gaukel
5,218,330 A 6/1993 Omiya et al.
5,304,968 A 4/1994 Ohtonen et al.
5,686,874 A 11/1997 Piirainen
5,754,084 A 5/1998 Hietala
5,963,856 A 10/1999 Kim
6,300,850 B1 10/2001 Kaegebein
6,396,366 B1 5/2002 Raty et al.
6,466,110 B1 10/2002 Wulff et al.
6,518,858 B2 * 2/2003 Ando et al. ..... 333/134
6,600,394 B1 * 7/2003 Wang et al. ..... 333/231
6,686,818 B1 * 2/2004 Weibler et al. ..... 333/231
6,724,261 B2 * 4/2004 Cheo ..... 330/295
2003/0218521 A1 11/2003 Andoh

* cited by examiner

CERAMIC LOADED TEMPERATURE COMPENSATING TUNABLE CAVITY FILTER

RELATED APPLICATIONS

This application claims priority to U.S. Provisional Application No. 60/582,448 filed in the U.S. Patent and Trademark Office on 25 Jun. 2004. U.S. Provisional Application No. 60/582,448 is incorporated herein by reference.

FIELD OF THE INVENTION

The present invention relates to cavity resonators, and specifically to a single-cavity tunable filter or resonator. The present invention also relates to diplexers, duplexers, combline filters and combiners, which incorporate the disclosed resonator.

BACKGROUND OF THE INVENTION

A common cavity resonator is the quarter wave transverse-electromagnetic (TEM) coaxial resonator ("TEM resonator"). In the TEM resonator the electric and magnetic fields lie in a transverse plane perpendicular to the conductors. The magnetic field is circular about the inner conductor. The electric field is axially symmetric about the inner conductor and extends from the inner conductor to the outer conductor. Current flows in the lengthwise direction along the surfaces of the conductors, in a direction perpendicular to both the electric and magnetic fields.

Two common characteristics or specifications used to determine/specify the performance of a TEM resonator are the length of the resonator and the Quality factor ("Q"). The length is generally specified as a quarter, or three quarter wavelength. This reflects the fact that the length of the resonator post is one-fourth or three-fourths of the length of the wavelength at the resonant frequency. The resonator post is formed by electrically shorting or connecting one end of the line, and leaving the other end open or electrically disconnected.

The quality factor Q of the resonator describes the sharpness of the system's response to input signals. A general definition of the quality factor Q that applies to acoustic, electrical, and mechanical systems, defines Q as equal to two times the product of the number $\pi$ (pi) and the ratio of the maximum energy stored at resonance to the energy dissipated per cycle. In an electrical circuit, energy is stored in the electric or magnetic fields associated with reactive circuit components and electrical energy is lost (to heat) whenever current flows through a resistance.

TEM resonators can be used in various devices, including for example voltage controlled oscillators (VCO's), pagers, GPS (Global Positioning System) systems, TV/radio/cellular/PCS communications, magnetic-resonance imaging (MRI) systems and the like in frequency ranges from 10 MHz to 3 GHz. A variety of military systems utilize these frequencies and many must be frequency-agile. Furthermore, the increasing needs of homeland security and the more than 20 million radio users in the United States are requiring that more communications equipment be added to already over crowded sites. In addition, the private radio systems utilized by commercial and public safety industries continue to face capacity restraints.

There is an increasing need for high Q cavity resonators of reduced size so the space saved can be used for additional equipment. In addition, cavity resonators with higher performance and lower cost are also required in order to work in more complex communication applications, such as narrowband digital frequency hopping radios.

SUMMARY OF THE INVENTION

The present invention overcomes the drawbacks of conventional cavity resonators, i.e., large housings, lengthy tuning times and frequency drift due to RF induced heating, while increasing performance and reducing costs by providing a ceramic loaded, temperature compensating, tunable, cavity resonator. This is achieved by replacing a portion of the resonator with a high Q (Quality) ceramic capacitor, for example a portion that functions as, or which can be modeled as, a transmission line. Because the capacitor has a higher Q than the length of transmission line section it replaces, the line can be shortened and the overall Q of the device increased.

According to an exemplary embodiment of the invention, the cavity resonator comprises an inner conductive post, an end cap positioned over an end of the conductive post, a ceramic disc, and a top plate, of which the ceramic is positioned between the end cap and top plate. The frequency of the cavity is adjusted by increasing/decreasing the distance between the surface of the end cap and the surface of the top plate. In an exemplary embodiment, the ceramic is not voltage tunable.

The ceramic's dielectric temperature coefficient and the holding mechanism's coefficient of expansion can be selected to compensate for any change in length of the inner post length and outer cylindrical cavity length. The measured frequency temperature stability of the invention over −30° C. to +60° C. is less than 2 ppm/° C. at 150 to 350 MHz, or 0.0002%.

BRIEF DESCRIPTION OF THE DRAWING FIGURES

A more complete understanding of the present invention may be derived by referring to the detailed description and claims when considered in connection with the Figures, wherein like reference numbers refer to similar items throughout the Figures.

DETAILED DESCRIPTION OF THE INVENTION

In the following description, for purposes of explanation and not limitation, specific details are set forth, such as particular circuits, circuit components, techniques, etc. in order to provide a thorough understanding of the present invention. However, it will be apparent to one of ordinary skill in the art that the invention may be practiced in other embodiments that depart from these specific details. In other instances, detailed descriptions of well-known methods, devices, and circuits are omitted so as not to obscure the description of the present invention with unnecessary detail.

A cavity resonator in its most basic form is a shorted transmission line/capacitor circuit. In the broadest sense, a transmission line is anything that electrically connects a load to a (voltage and/or current) source. Depending on characteristics of the signals carried or conveyed by the transmission line, for example frequency and amplitude, different features or characteristics of the line become important. One characteristic of a length of transmission line is its Q (Quality), which is based on the impedance, outer diameter, conductivity, surface roughness, temperature and length of the transmission line. The impedance is proportional to the logarithm of the diameter ratio of the outer cylinder inside diameter to inner coaxial post outer diameter.

The capacitance of the cavity resonator can be provided by a dielectric parallel plate capacitor. The capacitance allows the transmission line to resonate at a particular frequency, and changing the capacitance will change the resonant frequency of the transmission line, or the frequency at which the transmission line resonates. Thus, by selecting or adjusting the capacitance, a desired resonant frequency can be achieved.

Unlike conventional TEM coaxial resonators which have a large gap between the end of the inner coaxial post and the outer ground plate, in accordance with exemplary embodiments of the present invention a resonator is loaded or provided with a ceramic disc. Specifically, some length of the resonator transmission line is replaced with a high Q ceramic or ceramic/air capacitor. Because the capacitor has a higher Q than the length of the transmission line section it replaces, the line can be shortened and the overall Q of the device can be increased.

Figure 1:
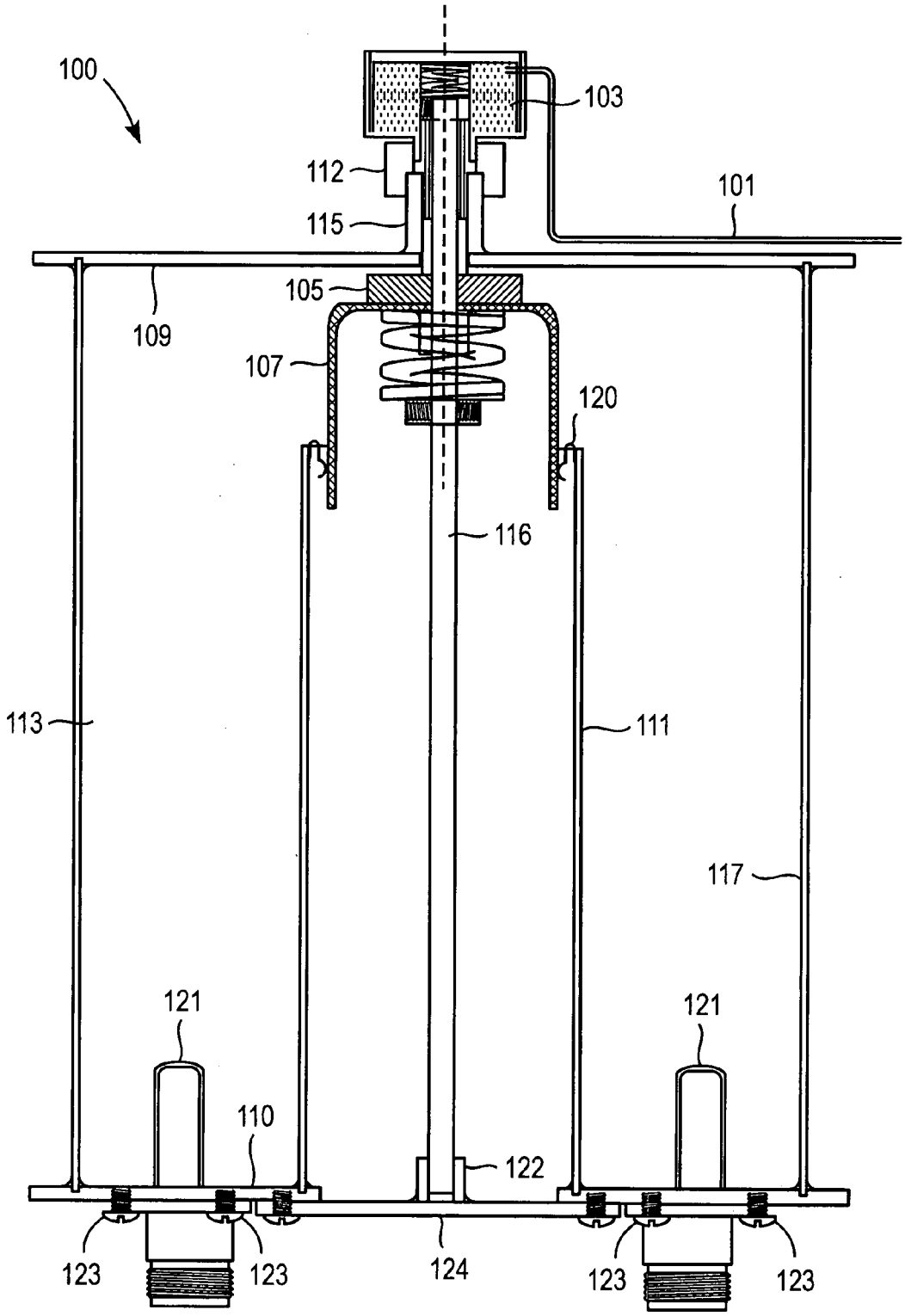
FIG. 1 is a cross sectional view of an electronically-tuned resonator according to a first embodiment of the invention.

FIG. 1 illustrates a cavity resonator 100 according to a first embodiment of the invention. The resonator 100 includes a cavity 113 formed between an outer cylinder 117, a top plate 109 and mounting plate 110. Within the resonator are a rod 116 (which can for example be made of alumina) supported at one end by a bushing 122 and a cover plate 124, and at the other end by a bushing 115 mounted on the top plate 109. An inner post 111 extends along at least part of the length of the rod 116, and includes contact fingers 120 that electrically connect the inner post 111 to an end cap 107. The end cap 107 can for example be made of copper, and can be silver plated. A ceramic disc 105 is located between the end cap 107 and the top plate 109, along a section of the rod 116. At least the surfaces of the end cap 107 and the top plate 109 are electrically conductive. Also shown in FIG. 1 is a shaft collar 112, which can be a locking shaft collar and which can for example be made of steel or any other suitable material. An electromagnetic coil 103 is also provided, and can be actuated via wires 101.

The conductive surfaces of the end cap 107 and the top plate 109 are held parallel at a distance, and together with the ceramic disc 105 form a capacitor. The capacitance of the capacitor varies with a distance between the conductive surfaces of the end cap 107 and the top plate 109. Bringing these closer together increases the capacitance, which lowers the center or resonance frequency. Conversely, moving the conductive surfaces of the end cap 107 and the top plate 109 further apart reduces the capacitance and increases the resonance frequency of the resonator 100. Therefore, the resonance frequency of the resonator 100 can be varied or controlled by controlling the distance between the conductive surfaces of the end cap 107 and the top plate 109.

The end cap 107 and the top plate 109 can be highly conductive in order to achieve a very high capacitor Q, which improves the resonator's performance in high power (i.e., large current) applications as well as in high selectivity filter applications.

Figure 2:
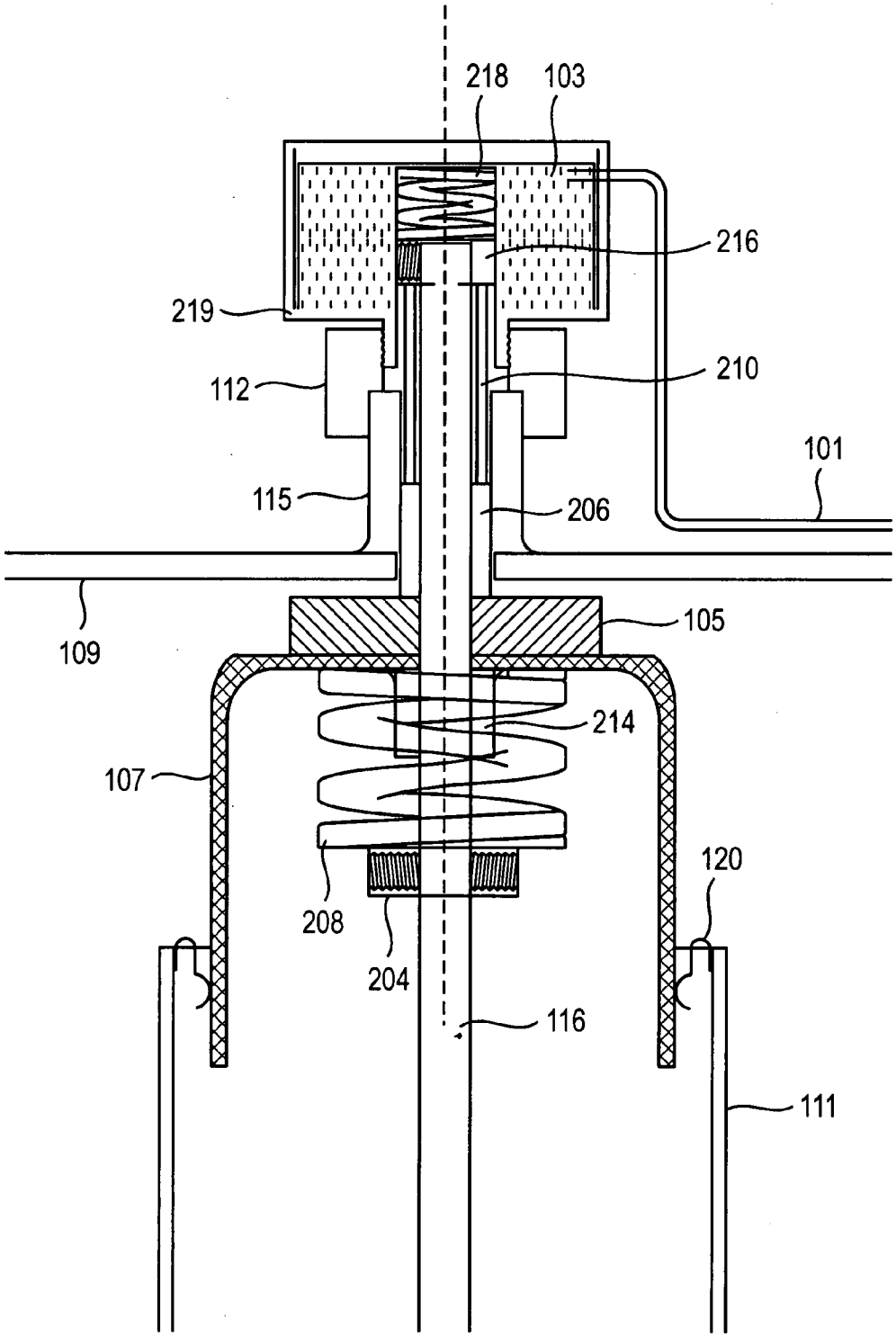
FIG. 2 is a magnified cross sectional view of the resonator of FIG. 1 from the end cap through the top plate.
Figure 3:
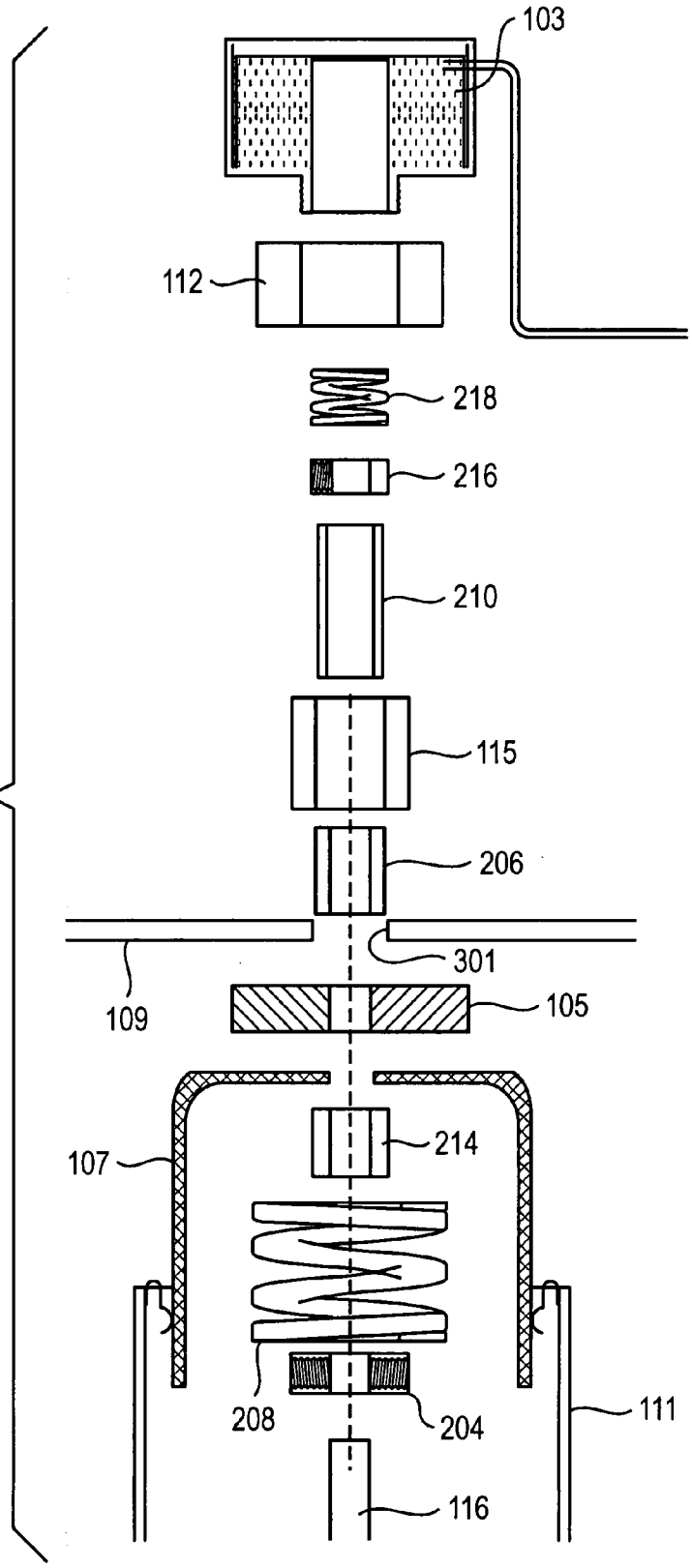
FIG. 3 is an internal view of the top plate of the resonator of FIG. 1.

As shown in FIGS. 1 and 2, the end cap 107 is pressed against the ceramic disc 105 along a non-conducting rod 116 by a spring 208. The spring 208 is shown as a coil spring in FIGS. 1–2. The spring can be any resilient, elastic, or flexible mechanism or device capable of providing a force to press the end cap 107 away from the shaft collar 204. The rod 116 can, for example, be made of alumina. The spring 208 is compressed between the end cap 107 and a shaft collar 204 mounted to the rod 116, and pushes the end cap 107 toward the disc 105. Because the disc 105 is only in contact with the end cap 107 by pressure of the spring 208, the disc 105 is free to expand axially in opposition to the spring pressure, for example due to thermal expansion. This can increase durability or longevity of the resonator 100 and in particular of the ceramic disk 105 by reducing strains induced by differing expansion rates/thermal coefficients of expansion of various components in the assembly, for example the ceramic disk 105, the end cap 107, the rod 116, and so forth.

In addition, allowing the ceramic disc 105 to expand and contract with temperature can result in a corresponding change in distance with temperature between the opposite conducting surfaces of the end cap 107 and the top plate 109, which helps stabilize the resonant frequency of the resonator 100 across different temperatures.

Signal loss or attenuation along a length of coaxial transmission line is measured at a certain rate per unit length. As is the case with a straight wire transmission line, the longer the length the greater the loss. The loss also increases in proportion to the square root of the frequency of the signal being transmitted through the transmission line. This holds true for coaxial cable, inductors, or a single wire, as a result of the skin effect at RF (Radio Frequency) frequencies, for example frequencies ranging from 10 Khz to 300 Mhz. This loss is dissipated as heat by the current-carrying conductors. In other words, the lost signal energy shows up as waste heat in the current-carrying conductors of the transmission line.

Loading or equipping a coaxial transmission line with a capacitance to form a resonator reduces the loss from the line, but the overall loss of the resonator will increase unless the loading capacitor Q is of the order of the Q of the line. However, the harmonic response of the line is extended according to the amount of the shortening of the line, independent of Q. For example, the signal frequency determines the wavelength of the signal, and the relation of the signal wavelength to the length of the transmission line influences the harmonic response of the transmission line.

High Q loading of a transmission line has been difficult to realize in the past, as the typical air capacitor Q is much lower than the coaxial line Q due to the very small air gap required to realize the capacitance (the air gap usually being much less than the distance between the inner conductive post 111 and outer cylinder 117). Additionally, the small air gap may cause flashover sparking and resultant breakdown under power.

Accordingly, thin, small-diameter ceramic substrates which reduce the length of a coaxial post have been used to increase the flashover voltage handling and produce extended stop band performance filters at the expense of Q. Additionally, the electrical currents flowing on the plates of the capacitor cause loss, which in turn results in RF-induced heating of the plates.

In the prior art, metallization schemes such as deposited thin films or silver fired conductors have been applied directly to the plates of the capacitor substantially increasing these losses. In accordance with exemplary embodiments of the present invention, highly conductive silver-plated copper material can be provided abutting the ceramic disc 105 or near the ceramic disc 105, dramatically reducing such losses.

Figure 4:
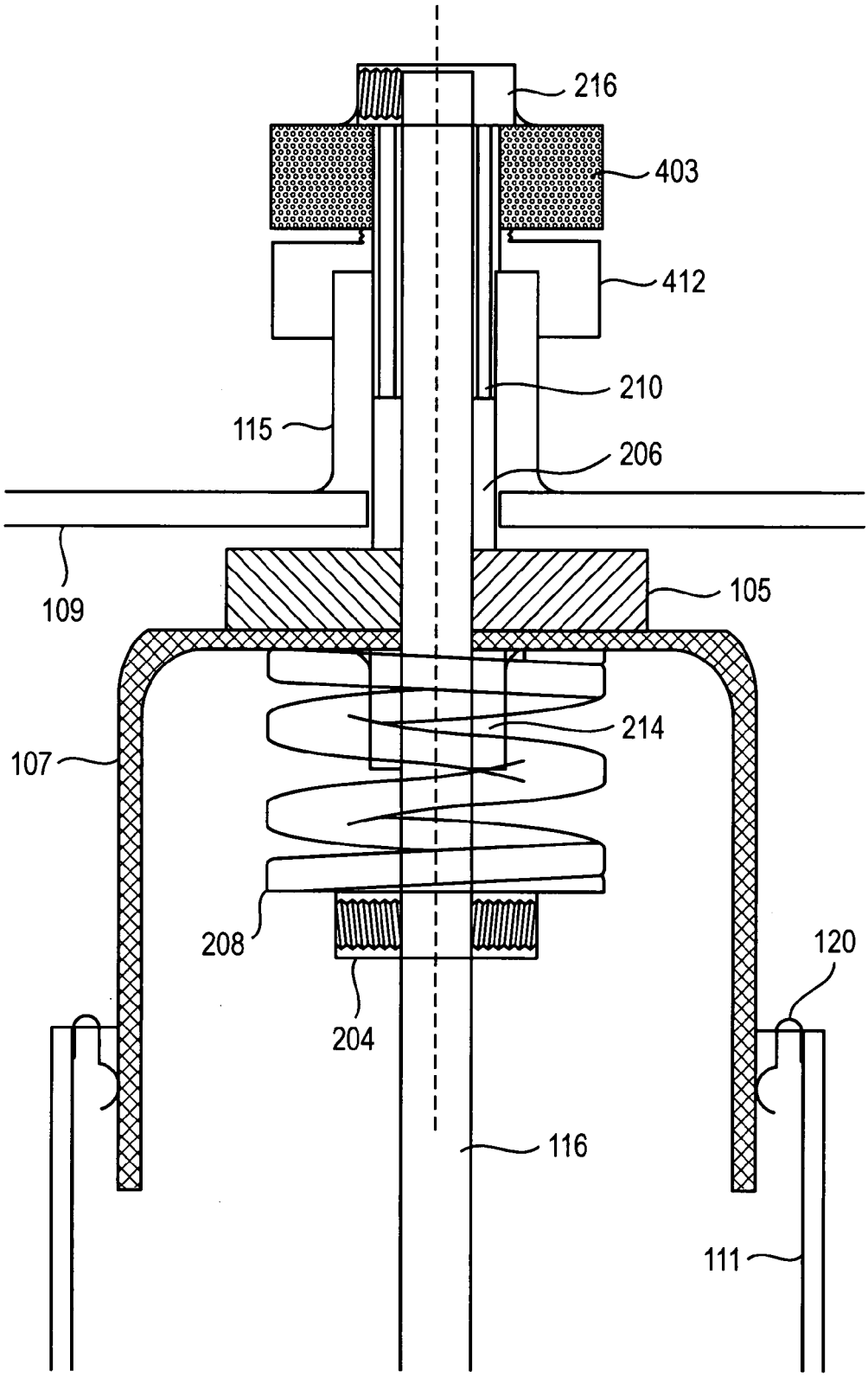
FIG. 4 is a cross sectional view of a mechanically-tuned resonator in accordance with another embodiment of the invention.
Figure 5:
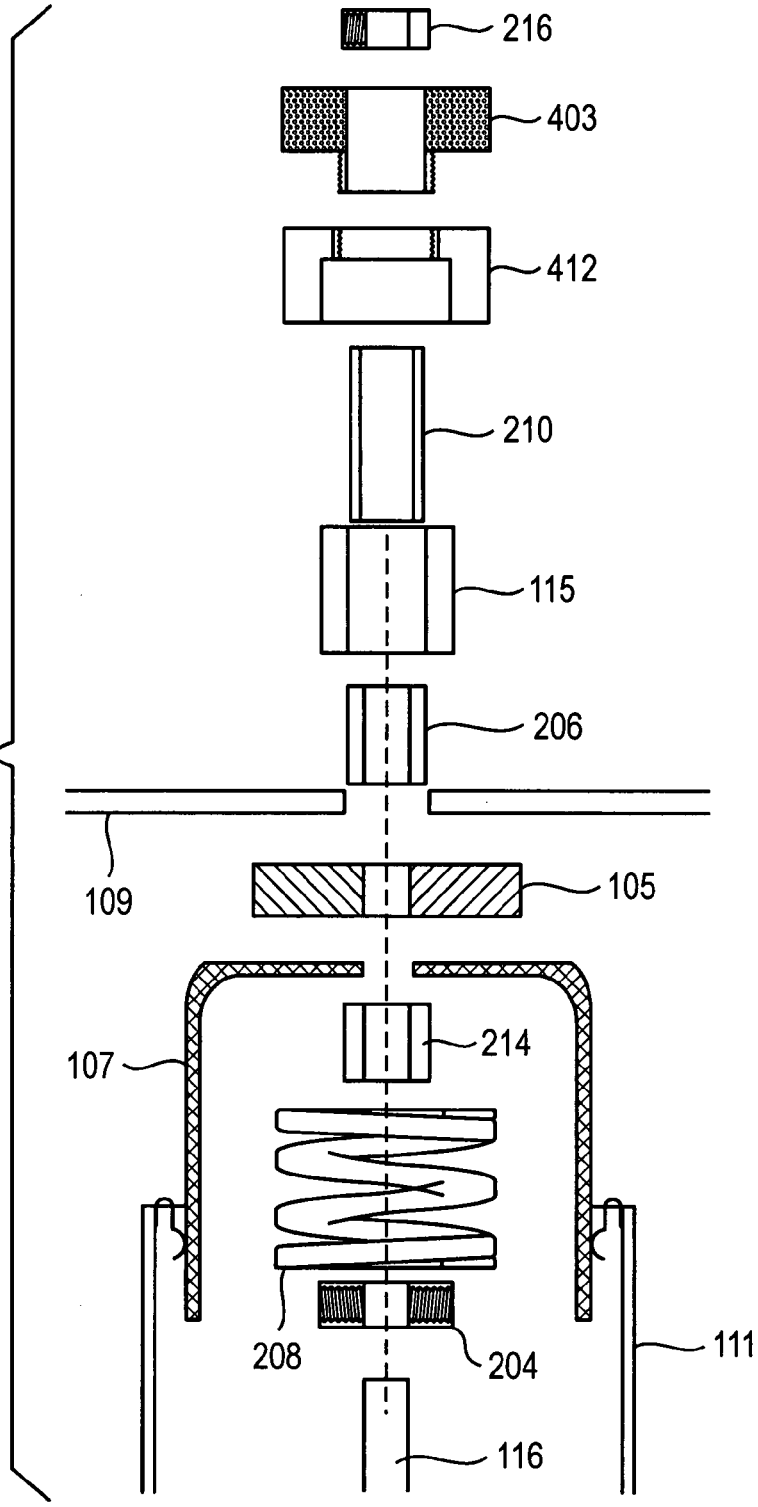
FIG. 5 is an exploded view of the resonator of FIG. 4.

Describing the resonator 100 now in greater detail, the resonator can be formed by shortening a cavity filter to less than a quarter wavelength, by replacing some length of the transmission line with a high Q capacitor such as the ceramic disc 105. Exemplary results are shown in FIGS. 1 and 4. Note that the inner post 111 forms part of the transmission line length. Replacing a portion of the inner post 111 with the ceramic disc 105 shortens the transmission line length, and also increases the overall Q of the resonator, because the ceramic disc 105 has a higher Q than the transmission line (the inner post 111 shown for example in FIG. 1) and because shortening the transmission line raises the Q of the transmission line.

The quality factor Q of a resonant electromagnetic system can be defined as the product (at resonance) of the angular frequency ω and the ratio of the total energy stored in the system to the power dissipated or otherwise coupled out of the system.

$$Q=\omega*\text{energy stored/average power loss}$$

Or written as:

$$Q=\tfrac{1}{2}(\text{Sum of reactances}+\omega*\text{sum of } dX/d\omega)/\text{sum of resistances} \quad (1).$$

Where Q=Quality factor,
X=reactance,
$\omega=2*\pi*f$,
f=frequency.

The input impedance of a low loss transmission line shorted at one end is $$Z=Z0\tan h(\alpha l+j\beta l)=R+j\,X,$$

$$R=Z0\sin h(2\alpha l)/(\cos h(2\alpha l)+\cos(2\beta l)),$$

$$R \text{ is approximately}=Z0\sin h(2\alpha l)/(1+\cos(2\beta l)),$$

$$X=Z0\sin(2Bl)/(\cos h(2\alpha l)+\cos(2\beta l)),$$

$$\text{and } X \text{ is approximately}=Z0\tan(\beta l).$$

where
α=line attenuation (Nepers/m),
$\beta=\omega/c$
l=line length (l<¼ wavelength),
c=propagation velocity of light,
R=series equivalent resistance,
Z0=impedance of the line.

Equating the reactance of the resonating capacitance to the reactance of the line at the resonant frequency gives:

$$X=Z0\tan(\beta l)=1/(\omega C)$$

$$\text{Or } C=1/(2\pi f Z0\,(\tan(Bl)),$$

Where C=Capacitance.

The reactance of the capacitance is equal to the reactance of the line at the resonant frequency, and therefore solving for C in the above equation determines the capacitance required to resonate the shortened transmission line at frequency f.

Thus the Q of a shortened length of transmission line is:

$$Q=\tfrac{1}{2}(\tan(\beta l)+\beta l/\cos^2(\beta l))/(\sin h(2\alpha l)/(\cos h(2\alpha l)+\cos(2\beta l)))$$

The Q of a full-length (quarter-wave) resonator thus reduces to:

$$Q=2.1715*\pi/(Ax)$$

where A=the line loss dB/inch, and x=the quarter wavelength in inches.

Extrapolating the transmission line length to zero in a limiting sense, the Q of the shortened transmission line section approaches double that of the quarter wavelength line.

Using a shortened length of line in series with a capacitor with a Q value equal to the shortened line, the resonant circuit Q is equal to the shortened line itself. Thus the Q of the now shortened transmission line and capacitor circuit is more than that of the quarter wavelength line.

The above does not account for the losses and resulting lower Q due to the shorting bottom plate 110, but this plate is made of highly conductive copper, and may be polished and silver plated to minimize those losses.

By way of example, a conventional unloaded quarter wavelength coaxial cavity constructed from a section of ANDREW's MAXCLine, where the published line loss of a 6 inch air line cable is 0.036 dB/100 feet at 55.25 MHz with a wavelength in inches of 213.774, results in a quarter (¼) wavelength Q of 4,255. Shortening this line to ⅛ wavelength, raises the Q of the line to 6,964, and adding a load of a resonating capacitor with a Q of 20,000 yields an overall Q of 9,742, over twice as large a Q in half the volume.

This same cable at 801 MHz has a loss of 0.142 dB/100 feet with a wavelength of 14.74 inches and a Q=15,644. Shortening this line to ⅛ wavelength raises the Q of the line to 25,603 and loading it with a resonating capacitor having a Q of 40,000 yields an overall Q of 30,389.

High-Q ceramics with Qs in excess of 20,000 to 40,000 at 1 GHz are now readily available. Therefore, at RF frequencies it can be a prime concern to replace a length of the coaxial conductor with a high Q capacitance to form a resonator, increasing the overall Q of the device.

Shortening the length of the transmission line can provide additional benefit by further extending the harmonic frequency response of the line. For a ¼ wavelength line, this occurs at the ¾ wavelength frequency or at 3 times the center (or resonant) frequency. Shortening this line in half, doubles that to 6 times the center frequency, Thus further extending the range at which interfering signals interact with the device.

The transmission line length of the resonator 100 is the length from the top of the end cap 107 to the mounting plate 110. Expansion of the shortened inner post 111 (e.g., thermal expansion) within the cavity 113 is not a concern because the end cap 107 slides along the post 111 during expansion. Expansion of the end cap 107 likewise is not of concern, since within the cavity 113 the end cap 107 slides along the post 111 during expansion. Merely keeping the line length constant with temperature, as in prior art, will not alone maintain temperature stability of the resonator 100 because the distance from the end cap 107 to top plate 109 (which determines the capacitance of the transmission line load) also must be controlled so as not to change the resonant frequency of the resonator 100.

In an exemplary embodiment, the contact fingers 120 are soldered to the shortened inner post 111 and form constant electrical contact with the end cap 107 to allow for expansion in the length of the outer cylinder 117 while maintaining electrical contact over the tuning range. In an exemplary embodiment, the contact fingers 120 are silver plated and constructed of highly conductive Beryllium copper material to flex with variations in temperature. Other suitable materials and attachment methods can be used to form constant electrical contact between the inner post 111 and the end cap 107.

The inner post 111, end cap 107, and outer cylinder 117, are each constructed of a highly conductive material, for example, copper. The inner post 111, the end cap 107, and the outer cylinder 117 can be constructed of the same material or of different materials having substantially the same coefficient of the thermal expansion, to result in matched expansion/contraction of the inner post 111, end cap 107 and outer cylinder 117 diameters with variations in temperature. Thus impedance that is proportional to a ratio of (inside diameter of the outer cylinder 117)/(outer diameter of the inner post 111) will not change with temperature because these components expand at the same rate.

According to a first embodiment of the invention shown for example in FIGS. 1–2, frequency tuning is performed by an electromagnet coil 103 acting on the shaft collar 216 which is clamped or otherwise attached to the rod 116. The shaft collar 216 can be made of steel or some other wholly or partially ferromagnetic material or structure. The shaft collar 216 can be wholly fixed to the rod 116 so that moving the shaft collar 216 in any direction also moves the rod 116. Alternatively, the shaft collar 216 and/or the shaft collar 204 can be arranged to rotate freely about the rod 116 while remaining longitudinally fixed to the rod 116, so that rotating the shaft collar does not rotate the rod, but moving the shaft collar closer to or further from the top plate 109 along the long axis of the rod 116 also moves the rod 116. As shown in FIG. 2, the ceramic disc 105, top plate 109, and end cap 107 are positioned surrounding the non-conductive rod 116, which can be made of alumina. The ceramic disc 105 is sandwiched between the shaft collar 216, an expansion tube 210, a spacer 206 which can be made of alumina or other suitable non-conductive material, the end cap 107, a spring 208, and the shaft collar 204. The shaft collar 204 is clamped or otherwise attached to the rod 116 so that the shaft collar 204 does not move along the long axis of the rod 116. FIG. 2 also shows a bushing 214 fastened to the end cap 107, between the end cap 107 and the shaft collar 204. This bushing 214 can act as a stop to limit travel of the shaft collar 204 and compression of the spring 208. The bushing 214 can also align surfaces of the end cap 107 and/or the disc 105 to be perpendicular to the rod 116 and/or parallel to an inner surface of the top plate 109.

Position of the coil 103 is fixed relative to the top plate 109 via the locking shaft collar 112 and the bushing 115. Accordingly, when electromagnetic forces generated by the coil 103 move the shaft collar 216 and thereby also the rod 116 relative to the coil 103, the distances from the top plate 109 to the ceramic disc 105 and the end cap 107 change until the ceramic disc 105 comes into contact with the top plate 109. After the ceramic disc 105 is in contact with the top plate 109, then further movement of the rod 116 that brings the shaft collar 204 closer to the top plate 109 compresses the spring 208 and increases the pressure between opposing contact surfaces of the ceramic disc 105 and the top plate 109. This is because the shaft collars 204 and 216 are fixed along the long axis of the rod 116, and the spring 208, end cap 107, ceramic disc 105, spacer 206, and expansion tube 210 are arranged between the shaft collars 204 and 216. The spring 208 presses the end cap 107, ceramic disc 105, spacer 106 and expansion tube 210 against the shaft collar 216, so that that when the shaft collar 216 moves with respect to the coil 103, they move also. As explained above, the coil 103 is fixed in position relative to the top plate 109 via the locking shaft collar 112 and the bushing 115. Thus, when the coil 103 moves the shaft collar 216, the distances from the top plate 109 to the ceramic disc 105 and the end cap 107 will change until the disk 105 comes into contact with the top plate 109, which changes the capacitance through the ceramic disc 105, between end cap 107 and top plate 109.

In an exemplary embodiment, the capacitance varies greatly with a small change in the gap distance between end cap 107 and top plate 109, and this allows the resonator frequency to be tuned more quickly and over a greater frequency range than can be achieved by servomotors in conventional tunable cavity filters. The capacitance change is nonlinear, because the capacitor includes air and ceramic.

The ceramic disc 105 is in direct contact with the end cap 107, which contacts the spring fingers 120 attached to the inner post 111. Since for a given setting or energization of the coil 103 the rod 116 will tend to move with the coil 103, the ceramic disc 105 and end cap 107 may move relative to the inner post 111 when the outer cylinder 117 thermally expands or contracts lengthwise. This can be considered in determining the resonance frequency temperature stability of the resonator.

Expansion of the outer cylinder 117 length forces the top plate 109, and thus ceramic disc 105, and end cap 107, to move away from the bottom mounting plate 110. The end cap 107 slides along the contact fingers 120 attached to the inner post 111 with minimum friction so as not to change the pressure on the holding mechanism of the ceramic disc 105. Thus the end cap 107 moves up and lengthens the total length of the coaxial line, which is the length from the top of end cap 107 to the bottom mounting plate 110 shown for example in FIGS. 1 and 9, lowering the frequency with increased temperature.

Furthermore, heat is conducted thru the ceramic disc 105 to the top plate 109. Thermal expansion of the top plate 109 as well as of the outer cylinder 117 increases the return current path along the top plate 109 and outer cylinder 117, and thereby increases an inductance of this return current path. Compensating for this thermally-induced inductance change can help stabilize the frequency of the resonator over a broad temperature range.

Heat is also conducted to the spacer 206 and the expansion tube 210 via the ceramic disc 105, the top plate 109 and the bushing 115. The distance from the end cap 107 to the top plate 109 can be controlled (when the ceramic disc 105 is not contacting the top plate 109) by providing a differential thermal expansion of a) the spacer 206 and the expansion tube 210 on the one hand (which by lengthening push the ceramic disc 105 further away from the top plate 109), and b) the bushing 115, the "adjusted" length of the shaft collar 112 between the casing of the coil 103 and the bushing 115, and the casing of the coil 103 on the other hand (which by lengthening push the coil 103 and the shaft collar 216 away from the top plate 109 and thereby draw the ceramic disk 105 closer to the top plate 109). Absent adjustments of the locking shaft collar 112 relative to the housing 219 of the coil 103 (e.g. by screwing the coil housing 219 further into or out of the bushing 115 via the interlocking threads shown in FIG. 2), the top plate 109, the bushing 115, the locking shaft collar 112, and the coil housing 219 have fixed position relative to each other (not counting thermal expansion of the components themselves) and have a constant effective length that is subject to thermal effects. Thus the bushing 115 and locking shaft collar 112 will tend to respond in the same way to thermal activity regardless of a distance between the top plate 109 and the disc 105. In contrast, when the ceramic disc 105 is further from the top plate 109 the expansion tube 210 will be closer to thermal activity at the capacitance, for example at the top plate 109 and the bushing 115, and when the ceramic disc is closer to the top plate 109, the expansion tube 210 will be further from this thermal activity. Of course, components that are further from the thermal activity can be less affected by it. For example, the bushing 115 will be more affected than the coil housing 219. The coil housing 219 can for example be made of steel, or any other material having structural qualities necessary to support function of the coil 103 and provide a desired or acceptable coefficient of thermal expansion.

When the outer cylinder 117 expands, length of the inner post 111 increases and inductance of the resonator 100 increases and correspondingly the capacitance must be reduced so that the same resonant frequency of the resonator 100 is maintained. Recall also that the relationship between capacitance and distance from the top plate 109 to the disc 105 is inverse and nonlinear, so that decreasing the separation distance increases the capacitance and a small decrease in distance between the ceramic disc 105 and the top plate 109 results in a greater increase in capacitance when the disc 105 is close to the top plate 109 than when the disc 105 is further from the top plate 109.

In an exemplary embodiment, the overall thermal coefficient of expansion of the expansion tube 210 and the spacer 206 is greater than that of the bushing 115, shaft collar 112, and coil housing 219. Thus when temperature increases, the net effect of expansion of the expansion tube 210, spacer 206, bushing 115, shaft collar 112, and coil housing 219 is to increase distance between disc 105 and the top plate 109, thereby lowering capacitance of the resonator 100 and compensating for the inductance increase caused by greater return current path length, due for example to thermal expansion of the top plate 109 and the outer cylinder 117 and compensates for the length increase between opposite ends of the post 111 and the end cap 107 (e.g., the length l of the line) caused by expansion of the outer cylinder 117.

Thermal effects on the expansion tube 210 decline as distance between the expansion tube 210 and the top plate 109 increases. Thus when the thermal coefficient of expansion of the expansion tube 210 is greater than that of the spacer 206 (as in an exemplary embodiment), the overall expansion rate of the expansion tube 210 and spacer 206 will be greater when the disc 105 is further away from the top plate 109 (and the expansion tube 210 is closer to the top plate 109) than when it is closer, and this can compensate for, or match, the non-linear relationship between capacitance of the resonator 100 and distance separating the disc 105 from the top plate 109. In an exemplary embodiment, the thermal coefficients of expansion of the spacer 206 and the expansion tube 210 can be selected to match the non-linear relationship between capacitance of the resonator 100 and distance separating the disc 105 from the top plate 109 to any desired degree. Lengths and relative lengths of the spacer 206 and expansion tube 210 can also be selected to adjust distances of the tube 210 from the top plate 109 and adjust proportional effects of expansion of the spacer 206 and expansion of the tube 210.

In another exemplary embodiment, the thermal coefficient of expansion of the expansion tube 210 is not greater than that of the spacer 206 so that the non-linear relationship of capacitance to separation distance is not compensated, even though the capacitance will still change with temperature to compensate for change in inductance with temperature albeit to perhaps a lesser degree of accuracy.

Note that when the ceramic disk 105 is in contact with the top plate 109, then expansion of the rod 116 between the shaft collars 204, 216 will tend to decrease contact pressure between the disc 105 and the top plate 109, whereas expansion of the shaft collar 112 and the bushing 115 will tend to increase contact pressure between the disc 105 and the top plate 109.

When the disc 105 and the top plate 109 are separated by a non-zero distance, capacitance and resonant frequency of the ceramic loaded resonator 100 are primarily determined by the capacitance of the dielectric disc 105 and the distance from the top surface of end cap 107 through the ceramic disc 105 and the air space to the top plate 109. When the ceramic disc 105 is in contact with the top plate 109, capacitance of the resonator can also be determined or affected by a contact pressure between surfaces of the disc 105 and the top plate 109.

In an exemplary embodiment, the ceramic disc 105 and conductive metal plates of the end cap 107 and the top plate 109 have a rough surface finish in terms of an average peak to valley distance commonly referred to as an "RMS" or root mean square average of the surface roughness. In an exemplary embodiment, the ceramic disc 105 and the metal surfaces of the end cap 107 and the top plate 109 have a 62 rms finish or less (smoother). By suitably adjusting the distance from the top surface of end cap 107 to top plate 109, exemplary embodiments can provide a frequency adjustment on the order of 200 MHz, for example, an exemplary resonator can have any resonant frequency in a range of 250 MHz plus or minus 100 MHz, or a range on the order of 200 MHz or greater centered on any appropriate frequency (e.g. 250 MHz as in the above example, or a smaller or larger frequency).

Exemplary embodiments can have one or both of a) an adjustable non-zero distance between the disc 105 and the top plate 109, and b) an adjustable pressure between the disc 105 and the top plate 109 in contact with each other. Thus in some embodiments the disc 105 is never in contact with the top plate 109, in other embodiments the disc 105 is always in contact with the top plate 109, and in yet other embodiments the disc 105 can be in contact or not in contact with the top plate 109.

When the disc 105 is in contact with the top plate 109, the resonant frequency can be adjusted by changing a contact pressure between the contact surfaces of the disc 105 and the end cap 107, and the contact surfaces of the disc 105 and the top plate 109. When a force squeezing the disc 105 between the end cap 107 and the top plate 109 is increased, the actual contact area of the opposing surfaces increases, which increases capacitance. Thus, the actual force holding the top plate 109 and the end cap 107 against the ceramic disc 105 affects the capacitance and thereby the resonant frequency of the resonator 100. For example, where a capacitance of 323.3 pF is used to load a post 6 inches long to resonate at 55 MHz, by changing the capacitance just 0.1% (0.30 pF) the resonant frequency will change by 50 kHz.

Since in an exemplary embodiment the surfaces of the ceramic disc 105 and the conducting plates 107,109 are not perfectly flat, pressing the surfaces together with greater force increases molecular surface area of contact, thus increasing the capacitance. This increased capacitance lowers the center or resonance frequency. Accordingly, the resonant frequency of the resonator 100 can be varied or adjusted by varying an amount of pressure between the contact surfaces of the dielectric disc 105 and the surfaces of the conducting plates, i.e., end cap 107 and top plate 109, or by varying an amount of force applied to the end cap 107 and top plate 109.

Examination of the surface of copper plates and ceramics under electron microscopy shows surface details explaining this result. Refer to FIG. 4, which shows an exemplary embodiment having the shaft collar 216 fastened to a nut 403 that in turn has threads mated to a shaft collar 412 that is attached to the bushing 115. When the nut 403 is turned, the mated threads move the nut 403 (and the rod 116 and attendant assemblies) closer to or further from the top plate 109. When the end cap 107, disc 105 and top plate 109 are in contact, loosening the nut 403 on the shaft collar 216 pulls the rod 116 and attached shaft collar 204, further compressing the spring 208 against the end cap 107 which in turn presses the ceramic disc 105 against the top plate 109.

In an exemplary embodiment the maximum force applied to squeeze the disc 105 between the end cap 107 and the top plate 109 is less than 100 lbs., deflects the spring 208 without bringing the shaft collar 204 into contact with the bushing 214. This relatively low force acting over the broad surface area of the ceramic disc 105 does not deform the disc 105 nor the surfaces of the top plate 109 or end cap 107 but they are simply strained to conform with each other under compression. The end cap 107 can slide along the rod 116 and relative to the inner post 111 with little friction and the contact fingers 120 soldered to the stationary center conductor post 111 maintain electrical contact between the end cap 107 and the inner post 111 with minimal friction, so as not to significantly affect the pressure applied to press the end cap 107, disc 105 and top plate 109 together.

As a result, to tune the resonant frequency in a range that can be provided with the disc 105 in contact with the end cap 107 and the top plate 109 (which includes the greatest capacitance and thereby the lowest resonant frequency of the resonator 100), compressive force is applied to modulate the contact surface pressure and consequent actual contact surface area between the ceramic disc 105, the end cap 107 and the top plate 109. This allows the resonator frequency to be tuned without the need for resonator components to move large distances, which allows for quicker frequency variation than can be achieved in conventional tunable cavity filters.

To allow frequency hopping in hostile environments for long range communications that make use of the HF/VHF/UHF spectrum, for example in combat radio systems, the tuning speed of the resonator must be as quick as possible. The tuning time of conventional servo motor tunable filters is on the order of two seconds, primarily due to the large movement of the mass of the mechanical tuning device. Since mass has momentum and must be moved and reversed quickly, to achieve the preferred tuning rates, the movement of any mass in the filter must be reduced as much as possible.

This is achieved in exemplary embodiments of the present invention by providing a tuning mechanism with relatively small movement because it is the capacitance that tunes the frequency adjustment as shown in FIG. 2, produced by tension along rod 116 being acted on by the electromagnet 103.

The electromagnet 103 can be a high frequency voice coil or solenoidal coil (similar to a speaker voice coil) which can be energized and reverse energized at up to 10,000 Hz. This results in a tuning speed of 1/10 millisecond, far better than the typical two second tuning time of conventional mechanical devices.

In an exemplary embodiment, applying current through wires 101 to electromagnet 103 driven by a dc programmable power supply, for example capable of 150 W, can apply enough force to the surfaces of ceramic disc 105 for example to move the frequency 1.0 MHz within about 30 milliseconds. A steady current applied to the coil 103 may also be used in a constant frequency application of the cavity filter 100. In an exemplary embodiment, some amount of current is always applied to the coil 103, which can improve the response of the coil 103 to provide desired adjustments to capacitance of the resonator with greater speed and/or accuracy.

According to the embodiment shown in FIG. 4, tuning of the resonant frequency can be performed by rotating the nut 403, which can be knurled and made of steel or another suitable material, on a threaded hollow shaft collar 412, which can for example be made of steel. The thread pitch can be selected to achieve a desired sensitivity or responsiveness, for example a desired rate of change in resonant frequency per rotation of the nut 403. Rotating the nut 403 causes shaft collar 216 and rod 116 and thus end cap 107 and disc 105 to move closer or away from top plate 109, thereby adjusting the capacitance and consequently the resonant frequency of the resonator.

Thermal expansion of the expansion tube 210 can push the disc 105 and the end cap 107 further away from the top plate 109 and thereby reduce the capacitance to compensate for increased inductance caused by thermal expansion of other components of the resonator, for example the outer cylinder 117. In the same fashion as described herein with respect to the embodiment shown in FIG. 2, in the embodiment of FIG. 4 the expansion tube 210 will effectively have a greater expansion rate when it is closer to the top plate 109 (and the disc 105 is further from the top plate 109), and if the thermal coefficient of expansion of the tube 210 is greater than that of the spacer 105 then this will compensate the non-linear variation of the capacitance with distance between the top plate 109 and the disc 105 and end cap 107. In addition, when the knurled nut 403 is closer to the top plate 109 there is less material between the top plate 109 and the knurled nut 403 to expand and offset the effect of expansion of the tube 210, and this can further help compensate for the non-linear variation of the capacitance with distance between the top plate 109 and the disc 105 and end cap 107.

For example, as the ceramic disc 105, is moved away from top plate 109 additional length of expansion tube length 210 minus length of threaded shaft collar is required to temperature compensate the cavity. This is because there is now less capacitance, so a greater change in distance is required. At very close spacing of ceramic disc 105 to top plate 109, a very small distance change will change the frequency greatly; accordingly, less length is required to effect the temperature compensation. This is achieved in the embodiment of FIG. 4 because under this condition the knurled nut 403 is at the further end of shaft collar 412, giving a near zero differential change in length of expansion tube 210, vs. length of threaded shaft collar 412 and tuning screw 403 against the rod 116.

At the lowest tuned frequency, where the end cap 107, disc 105 and top plate 109 are in contact and the spring 208 is sufficiently compressed so there is play between one or more of the disc 105, bushing 206, expansion tube 210 and shaft collar 216, thermal expansion of the rod 116 will modulate tension in the spring 208 and thereby modulate pressure between the end cap 107, disc 105 and end plate 109 and consequently capacitance of the resonator to compensate for thermally-induced changes in inductance of the resonator. Note that thermal expansion of the bushing 115, shaft collar 412 and nut 403 will tend to increase spring pressure, so expansion of the rod 116 between the shaft collars 216 and 204 needs to be greater than expansion of the bushing 115, shaft collar 412 and nut 403 to provide a net reduction in spring pressure with temperature increase. Thus, thermal expansion of the rod 116 when the end cap 107, disc 105 and top plate 109 are in contact can provide temperature compensation to maintain a particular resonant frequency setting within a specified or desired degree of accuracy over a range of temperatures that the resonator may be subject to. Exact temperature compensation can thus be achieved over the broadest frequency range.

Figure 8A:
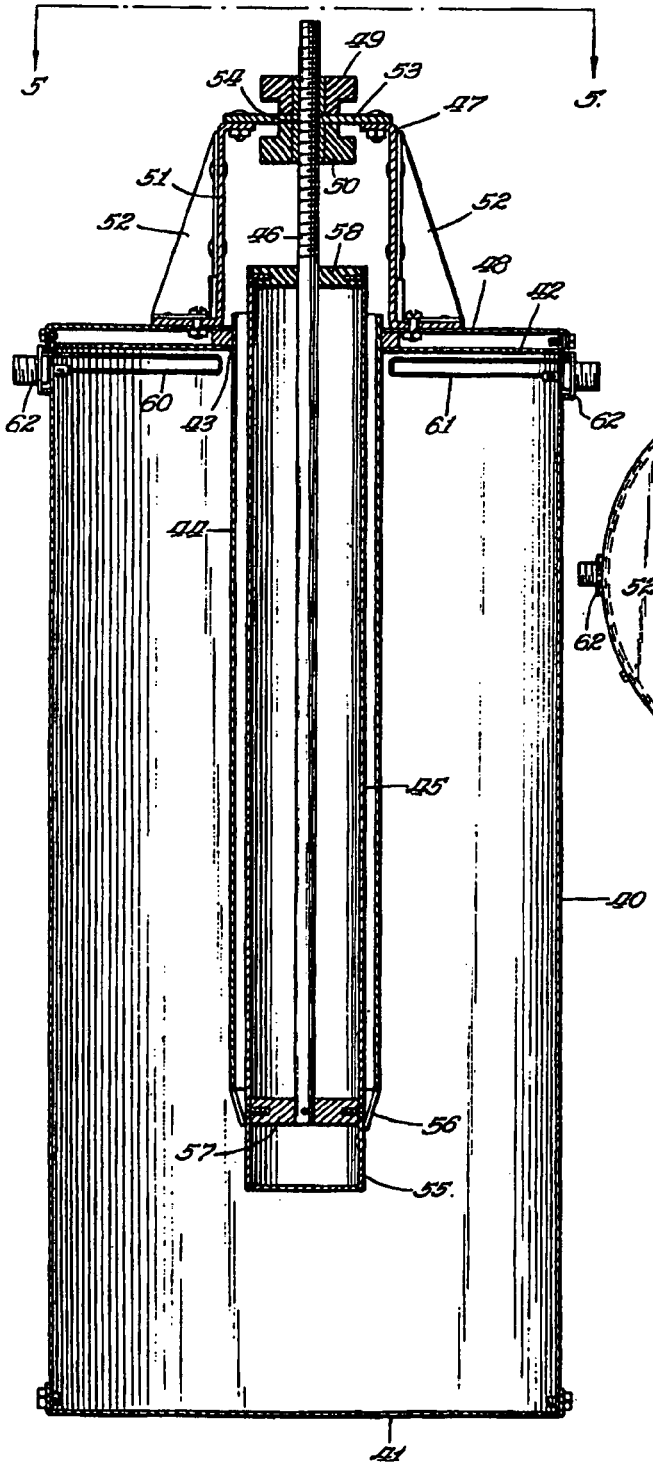
PRIOR ART FIG. 8A
FIG. 8 is a resonator according to the prior art.
Figure 8B:
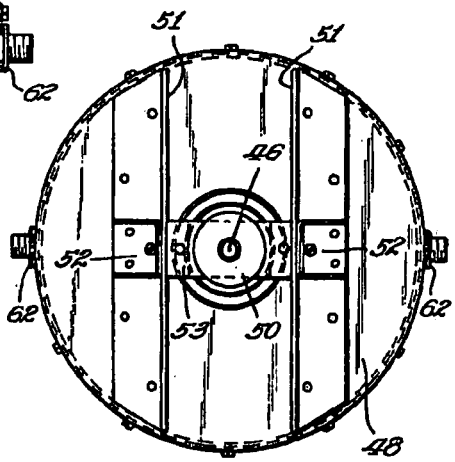
PRIOR ART FIG. 8B
Figure 8C:
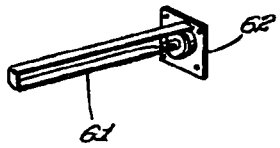
PRIOR ART FIG. 8C

In a conventional tunable cavity shown in FIG. 8, a long screw made of INVAR metal alloy is attached to the top of a conducting center probe extension of the inner post, through the center of the post and extending out of the cavity. Rotating the long screw tunes the resonant frequency of the cavity. However, to achieve the same tuning range as exemplary embodiments of the present invention, the INVAR screw would have to move thru a distance of perhaps 6 inches. In contrast, in an exemplary embodiment of the present invention the tuning nut 403 need only be rotated a few turns to achieve the same result.

A characteristic of conventional TEM resonators is the large gap between the open end of the inner coaxial post to the top ground plate. Accordingly, the frequency is determined based only on the length of the inner post. Therefore, conventional resonators need only compensate for possible expansion/contraction of the inner post. In contrast, the exemplary embodiments of the present invention load the post with a ceramic dielectric disc forming a capacitor.

Within the ceramic disc 105 the electric field is vertical and the magnetic field is circular, axially symmetric and parallel to the conductive surfaces of end cap 107 and top plate 109 with current flowing on the surface of the end cap 107 along the path from the inner hole to the outer diameter perpendicular to the magnetic field. These fields are analogous to a cylindrical cavity (except there are no side walls), which in general has a Q proportional to the volume-to-surface area ratio. Although some fringing capacitance exists from the outside surface of the end cap 107 to the top plate 109 without going through the ceramic disc 105, it is small relative to the ceramic capacitance, its net effect can be combined in with the ceramic capacitance when choosing a temperature coefficient of dielectric constant for the ceramic disc 105.

Figure 11:
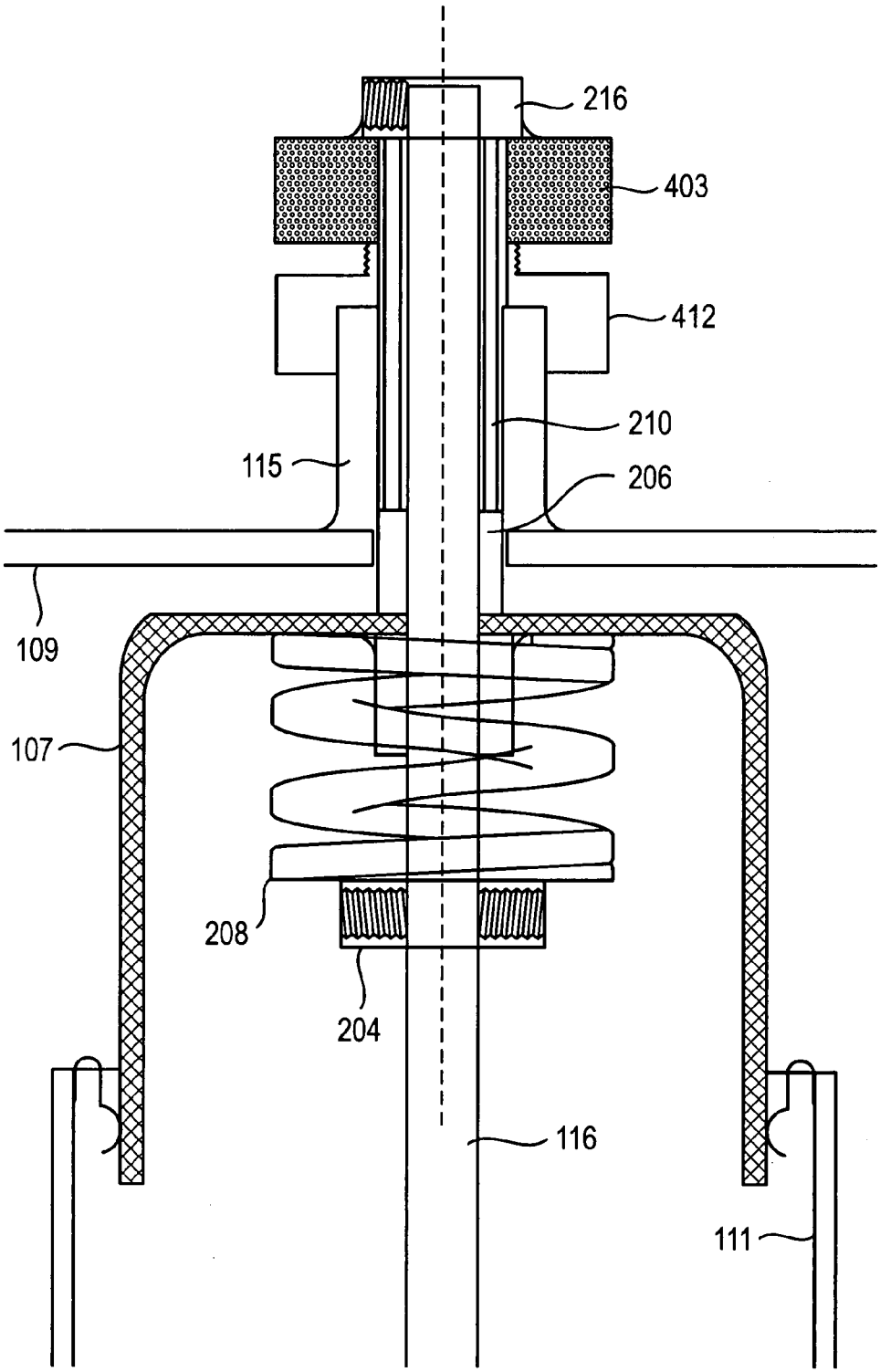
FIG. 11 illustrates a view similar to FIG. 7 with the ceramic disc omitted in order to show details of the expansion tube and tuning screw.
Figure 12:
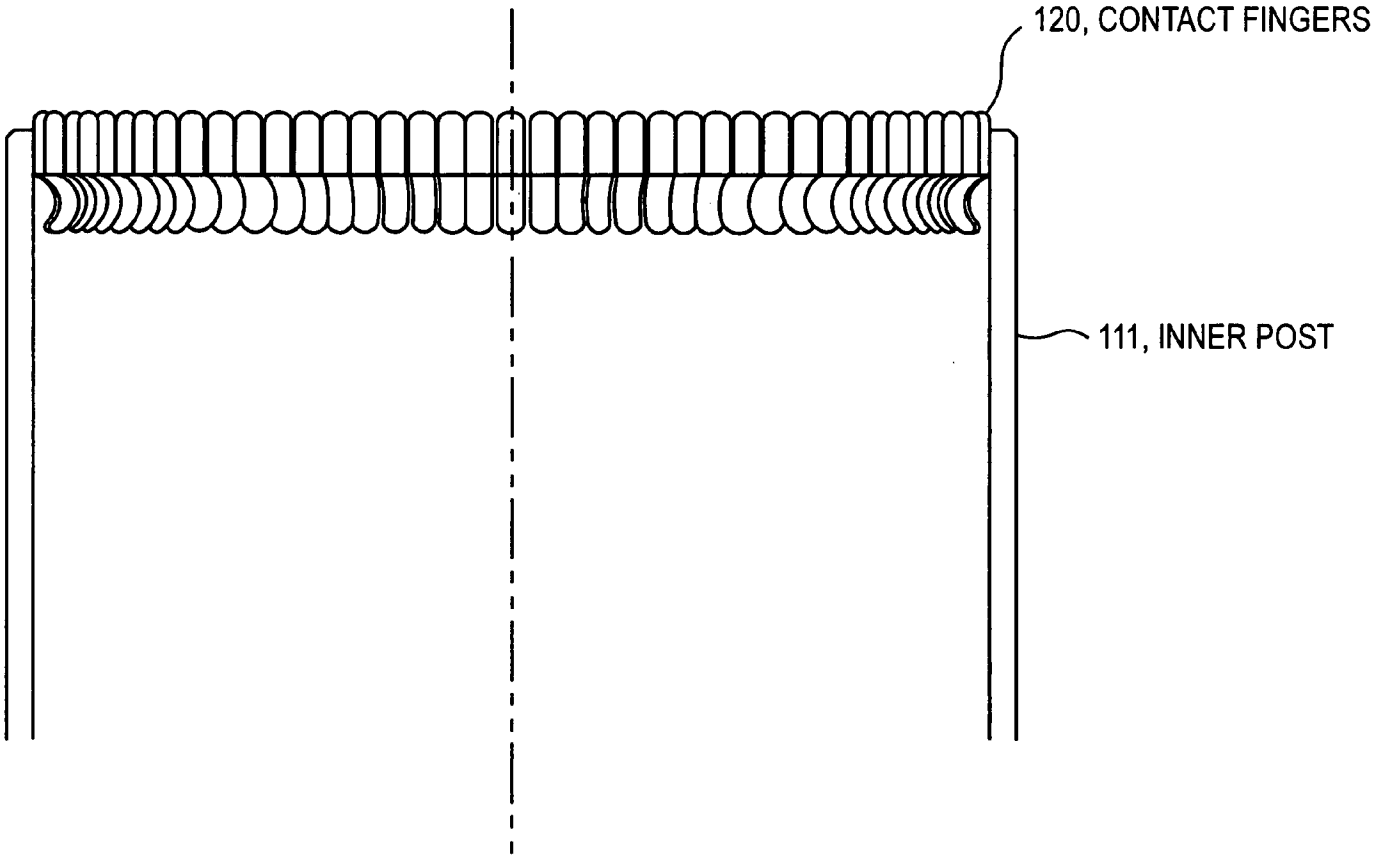
FIG. 12 illustrates the inner post 111 and contact fingers 120.
Figure 13B:
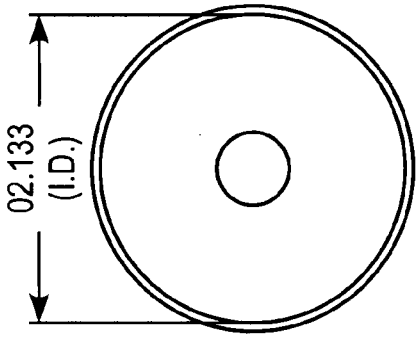
FIG. 13B shows an end view of the exemplary end cap.
Figure 13C:
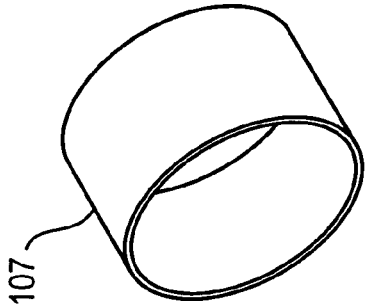
FIG. 13C shows a perspective view of the exemplary end cap.
Figure 13D:
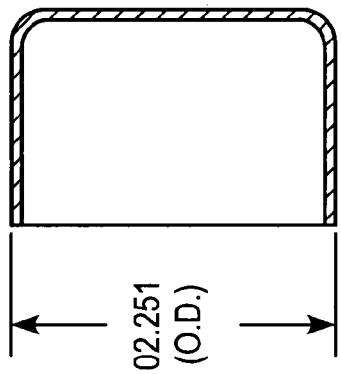
FIG. 13D shows a side cross-sectional view of the exemplary end cap, with dimensions shown in inches.
Figure 13A:
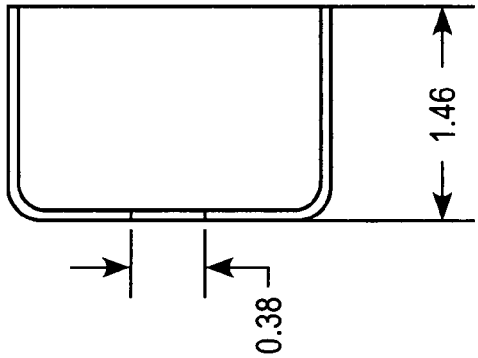
FIG. 13A shows a side view of an exemplary end cap.

The dielectric increases the current densities on the surface of the end cap 107 and top plate 109, where the ceramic disc 105 is the dielectric between them. This increased current density causes higher loss because of the presence of the dielectric. As such, it is beneficial to consider the Q of the loading capacitance not just by the dielectric Q, but also by the conductivity of the end cap 107 and the top plate 109 in contact with or near the loading capacitance. Even if there were no ceramic disc, as shown in FIG. 11, the Q would be affected, because the net capacitor Q equals the product of the dielectric Q and of the conductor Q divided by the sum.

In exemplary embodiments, there is no thin film plating or silver firing on the ceramic disc 105 itself, as these materials have lower conductivities and can cause high losses, in addition to making the tuning method either fixed or mechanically slow, as might be done in rotating exposed plate areas against unexposed areas of bare ceramic.

There can be a trade-off in selecting the dielectric constant of the material for the loading capacitor 105, because a high dielectric constant gives increased capacitance at the expense of increased current density and thus loss on the plates of the end cap 107 and the top plate 109. However, a low dielectric constant does not achieve the benefit of reducing the post length 111. In an exemplary embodiment, the dielectric constant of the ceramic disc 105 is 43 and the material composition of the ceramic disc 105 is ZrZn TiNb.

It can be desirable to reduce the length of the coaxial inner post 111 as short as possible, for example to make the resonator more compact. One solution is to reduce the thickness of the ceramic 105 to increase the capacitance and thereby allow for the length of the post 111 to be shortened. However, there are two detrimental effects in doing so, the first being a reduction in the Q of the capacitor (reduced volume) and the second being a reduction in the flashover voltage handling. To have high power handling and high enough Q, in an exemplary embodiment the ceramic disc 105 has a sufficient thickness, for example on the order of 3 millimeters which can allow the resonator to handle at least 100 Watts.

The ceramic disc 105 can be provided with a larger diameter to provide a corresponding larger surface area for contacting surfaces of the end cap 107 and top plate 109 and thereby increases the capacitance and Q by reducing the current density and increasing volume, but too large a diameter can lead to difficulty in maintaining flatness and may induce bending stresses to the point of cracking the ceramic during high speed tuning. In an exemplary embodiment of the present invention, the ceramic disc 105 has a diameter of 2 inches.

Figure 6:
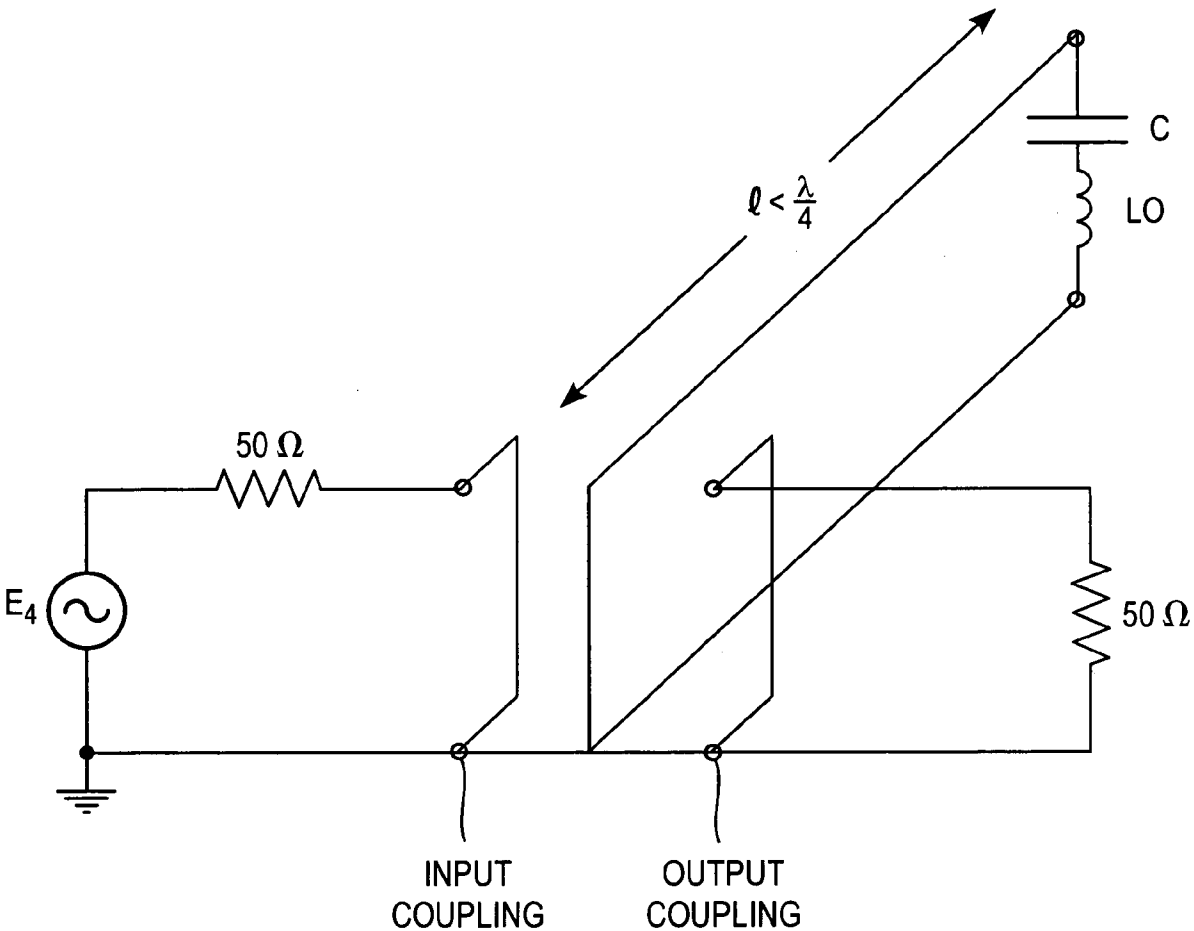
FIG. 6 is an electrical schematic of a resonator in accordance with an embodiment of the invention.
Figure 7:
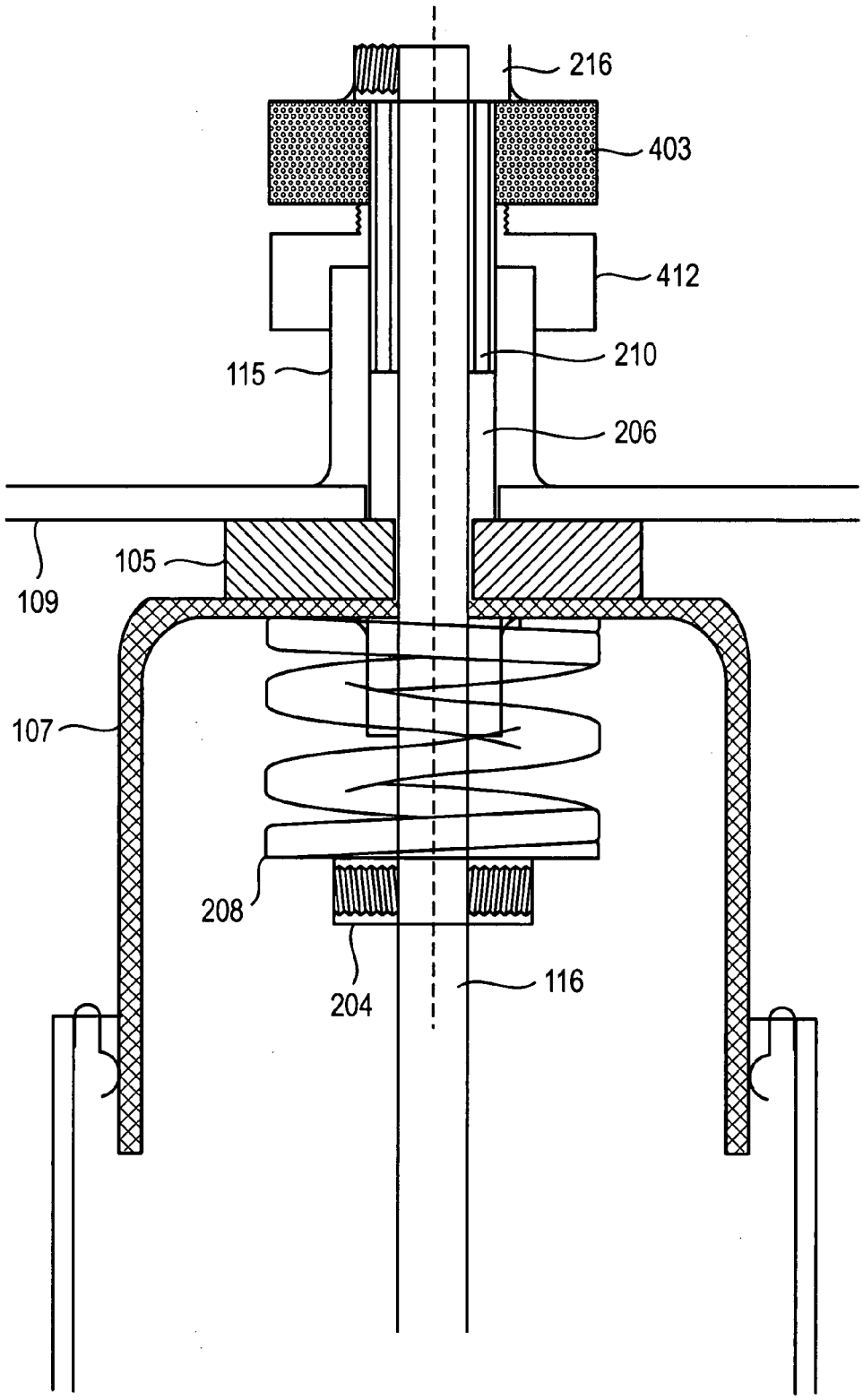
FIG. 7 is a cross sectional view of the resonator of FIG. 4 with tuning at maximum capacitance (lowest resonance frequency).

As mentioned, current flows on the surface of end cap 107 along the path from the inner hole to the outer diameter and equally on the interior surface of the top plate 109, parallel and outwardly from hole in the top plate 109 through which the spacer 206 passes toward the outer cylinder 117. The current on the top plate 109 travels a distance of about 3 inches more than that on the end cap 107. This is the distance from the edge of ceramic disc 105 to the inside edge of the outer cylinder 117 and down the outer cylinder 117 to a height of the top of the end cap 107 (which top is adjacent to the disc 105). This additional path length thus appears as an impedance to the capacitor in the return path. This is modeled as an inductance $L_0$ as shown in the schematic of FIG. 6. Heating of the outer cylinder 117 and top plate 109 increases this current path length due to thermal expansion and if uncompensated, would cause a lowering of the resonant frequency of the resonator.

Expansion of the outer cylinder 117 length forces the top plate 109, and thus ceramic disc 105, and end cap 107, to move away from the bottom mounting plate 110. The end cap 107 slides along the contact fingers 120 attached to the inner post 111 with minimum friction so as not to change the pressure on the holding mechanism of the ceramic disc 105. Thus the end cap 107 moves up and lengthens the total length of the coaxial line, which is the length from the top of end cap 107 to the bottom mounting plate 110 shown for example in FIGS. 1 and 9, lowering the frequency with increased temperature.

Since the top plate 109 is directly connected to the outer cylinder 117, in a direct thermal connection to the ceramic disc 105, the ceramic disc's thermal dielectric coefficient can be selected to at least partially compensate for the expansion of the top plate 109 and length expansion caused by the outer cylinder 117. This overcomes the limitation of the prior art resonators' inability to temperature compensate under high RF heating conditions. In conventional cavities, long thermal paths exist between external compensating structures and the source of the RF induced heating which is near the open end of the long inner post.

In an exemplary embodiment, the ceramic disc 105 has a linear coefficient of expansion of about +8 ppm/degree Centigrade, thus increasing in area and thickness with temperature. However, if the dielectric constant of the ceramic is chosen to have a temperature coefficient of about −26 ppm/° C., the capacitance $C=e_r\ e_0\ A/d$ of the disc 105, reduces with increasing temperature enough to compensate itself, causing no frequency shifting due to the ceramic.

Thermal expansion coefficients of the non-conductive spacer 206, and rod 116 (which can both be made of Alumina for example), can be well matched to the ceramic disc 105 material expansion, for example by having a +7 to +8 ppm/° C. expansion coefficient. In an exemplary embodiment, thermal expansion coefficients of the steel threaded shaft collar 412, steel knurled threaded tuning screw 403, steel housing 219 of solenoid coil 103, and steel locking shaft collar 112 have a +10 ppm/° C. linear coefficient of expansion. Aluminum expansion tube has a +23 ppm/° C. expansion coefficient.

In an exemplary embodiment, the length of the expansion tube 210 and the spacer 206, and also the spring rate (including whether the rate is constant or variable/progressive), spring shape and material of the spring 208, can be empirically adjusted or selected so that exact thermal frequency compensation is obtained. Expansion of the holding mechanism can be made to either increase or reduce pressure on the ceramic disc 105 with a change in temperature in the case of lowest frequency, and either increase or reduce distance of the ceramic disc 105 to the top plate 109, with a change in temperature, and thus additionally correct for any deviation to the compensation provided by the ceramic disc 105.

In exemplary embodiments, thermal path lengths are as short as possible to keep the temperatures of the resonator stable at high power conditions, for example 350 Watts, and under varying ambient conditions. This is achieved in exemplary embodiments of the present invention because the end cap 107 is in direct thermal contact with the ceramic disc 105 and both are in direct thermal contact with the rod 116, both the rod 116 and the disc 105 are in direct contact with the spacer 206 which in turn contacts the bushing 115 attached to top plate 109. Thus, rapid thermal dissipation occurs from the end cap 107 to the top plate 109 to the outer cylinder 117 and the mounting plate 110.

As a result, all temperature effects on the outer plate 109, the ceramic disc 105, the end cap 107, and the inner post 111, in addition to the outer cylinder 117, are accounted for in order to stabilize the frequency of the resonator 100, over a broad range of frequencies and temperatures, for example from −30° C. to +60° C. even while high RF power (for example, 350 Watts or more) is being applied to the resonator 100.

Figure 9:
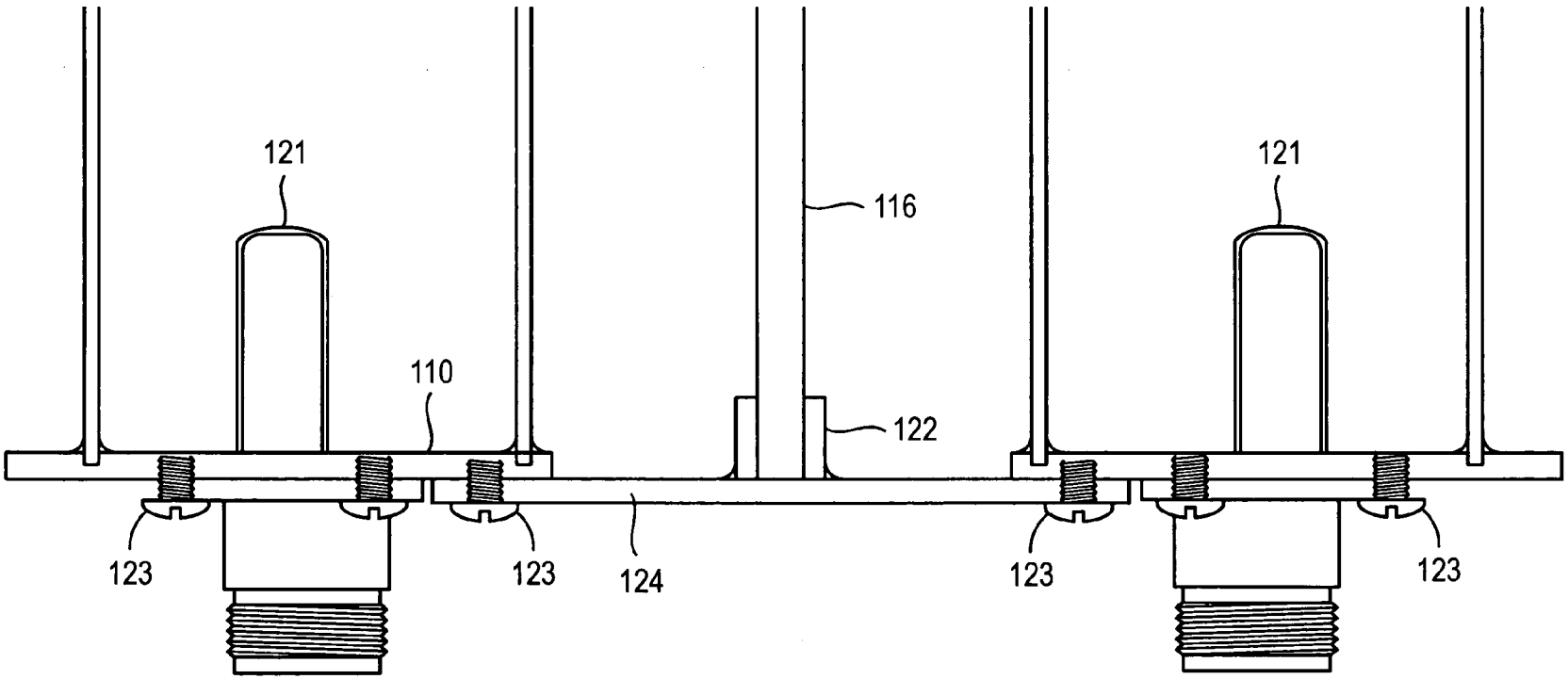
FIG. 9 illustrates a bottom plate attachment having bushing support for an Alumina rod.
Figure 10:
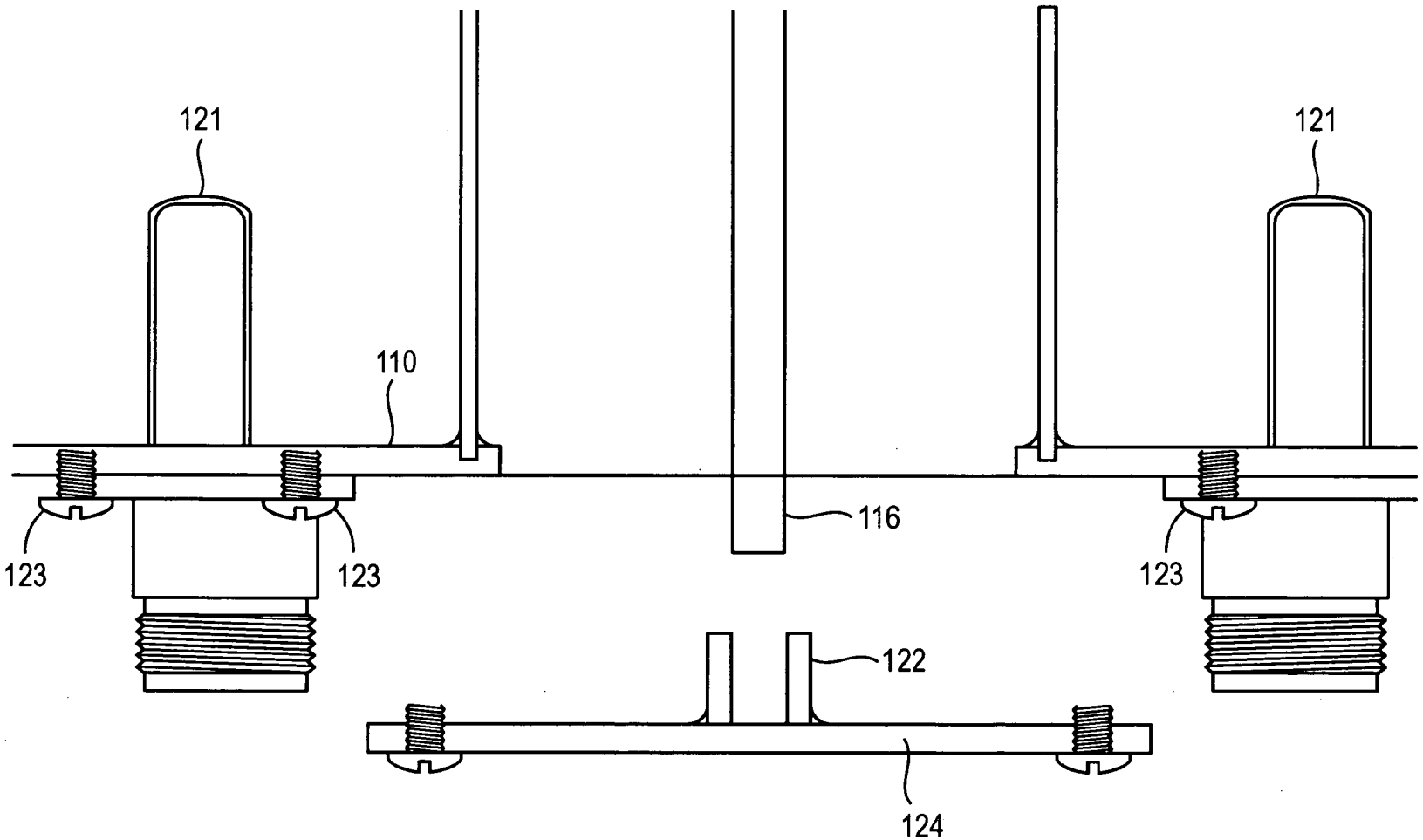
FIG. 10 is an exploded view of the assembly of FIG. 9.

In an exemplary method of tuning the resonator of FIG. 2, when the coil 103 is in a deenergized state, the rod 116 is pushed by the spring 218 to fully seat in the bushing 122 as shown in FIG. 9. This is not tuned at this frequency—a small current is applied to the coil 103 to set the initial and highest tuned frequency produced by the smallest capacitance. This small bias current of the coil 103 fixes the initial start frequency and energizes the coil 103 so that subsequent increases in current to the coil 103 cause motion of the shaft collar 216 or adjustment of resonance frequency without a long time delay for initial magnetization.

In an exemplary embodiment, the rotatable coupling loops 121 shown for example in FIGS. 1 and 9 are adjusted and then secured tight against mounting plate 110, for example via screws 123, to give the desired bandwidth and VSWR.

A single saw-toothed shaped pulse of current is passed thru the electromagnetic coil 103, and swept with a network analyzer, the frequency of the output of the network analyzer being recorded along with the exact voltage and current applied to the coil and a temperature of the coil.

A calibration curve is thus obtained of the drive current vs. frequency. Because the cavity 100 is stable with temperature, only one calibration curve is needed. The curve can be stored, for example, in a computer and can be used by a simple program to adjust the resonant frequency of the resonator 100 device to desired values.

The coil 103, is subject to a steady temperature rise as in any electromagnet, however this can be easily measured with a thermistor attached to the body of the electromagnet 103, calibrated and integrated or accounted for within the control program for the coil in use. This keeps the thermistor in the drive power control loop of the controller; no closed loop control of the center frequency is required.

The control drive outputs the control voltage to the coil and the resonator is then at the associated calibration frequency. This is a great improvement over prior art controllers that require sampling of the RF signal in order to lock on to a specified frequency. In fact, exemplary resonators in accordance with the present invention can be set to a frequency without an RF locking signal being applied and can thus be used for receiving as well as transmitting modes, because they set to whatever frequency is commanded. Sampling can be problematic when in a receiving mode, because in order to obtain a sample an RF signal must be transmitted using the resonator, at a time when the resonator should be used to listen or receive instead of transmit. Exemplary embodiments of the present invention avoid this problem completely by not requiring sampling of the RF signal.

If in the field the coupling loops 123 need adjustment, and thus detune the resonator 100 from an initial setting, the locking shaft collar 112 can be carefully readjusted to recapture the initial setting.

A very beneficial use of the invention is application of a simple dc source to the coil 103, to obtain a frequency offset. This offset is required in repeater radio links, where transmit frequency is offset from the receiver frequency. By using the device in this radio application, a single filter can be used for transmit and receive, replacing the very costly and bulky duplexer normally used. In this application the filter is connected to the antenna, followed by a transmit/receive switch. Application of the dc current to the coil is by keyed switching control linked to the microphone function control. In either receive or transmit, the filter will be tuned on the desired frequency within milliseconds.

In exemplary embodiments of the invention described herein, the loaded shortened transmission line does not produce a second passband until many times the center or resonance frequency of the filter or resonator. This provides great benefit by avoiding responses to out-of-band interference signals or preventing those out-of-band signals from passing thru the filter. Thus exemplary embodiments can be especially beneficial when used in direct conversion receivers. The filter and LO synthesizer can be tuned to produce a single constant IF directly from the RF avoiding multiple down conversions. This is not possible in fixed tuned filters, as the bandwidth of the filter has to be wide enough to allow passage of multiple channels, in which the LO synthesizer is tuned to select a specific channel to down convert, the interfering image of the desired channel would also be present at the IF. By being able to tune the narrow band filter and LO synthesizer to only one RF channel, the undesired image is rejected, eliminating at least one down conversion stage within the receiver.

By suitable selection of cables and rotatable coupling probes, a notch filter, duplexer, diplexer, and combiner, or multiple bandpass or bandpass with notch filters can all be fabricated using the present invention, and can all be tunable. Multiple resonators in accordance with the present invention can be constructed within a single housing with aperture coupling to form a combline filter.

Multiple resonators or filters in accordance with the present invention can be singly tuned or gang tuned. A computer such as a personal computer or microcontroller can run or operate multiples of filters, each filter having its own controller driver and the computer commanding each individual controller and associated cavity on a time division multiplex scheme. Alternatively, a computer and controller can be individually provided with each resonator/filter, simply set to a frequency, and can be externally networked to allow control commands for the filter be sent from a different location.

The invention has been described with reference to particular embodiments. However, it will be readily apparent to those skilled in the art that it is possible to embody the invention in specific forms other than those of the preferred embodiments described above. This may be done without departing from the spirit of the invention.

Thus, the preferred embodiment is merely illustrative and should not be considered restrictive in any way. The scope of the invention is given by the appended claims, rather than the preceding description, and all variations and equivalents, which fall within the range of the claims, are intended to be embraced therein.

What is claimed is:

1. A cavity resonator, comprising an inner conductive post arranged within a cavity of the resonator;

a conductive end cap positioned on an end of the inner conductive post;

a conductive outer plate forming a boundary of the cavity; and a ceramic disc arranged on the conductive end cap and opposite an inner surface of the conductive outer plate, wherein a distance between the ceramic disc and the outer plate determines a capacitance of the resonator.

2. The resonator of claim 1, wherein when the end cap and the outer plate are in direct contact with the ceramic disc, a pressure between the end cap and the ceramic disc and a pressure between the ceramic disc and the outer plate determine a capacitance of the resonator.

3. The resonator of claim 1, comprising a support that locates the ceramic disc relative to the outer plate, wherein thermal expansion of the support decreases capacitance of the resonator.

4. The resonator of claim 3, wherein a decrease in capacitance of the resonator caused by thermal expansion of the support offsets an increase in inductance of the resonator caused by thermal expansion of the resonator.

5. The resonator of claim 3, wherein the decrease in capacitance matches the increase in inductance to maintain a resonant frequency of the resonator.

6. The resonator of claim 1, wherein the conductive end cap moves relative to the inner conductive post with change in temperature and/or capacitance while remaining in electrical contact with the inner conductive post.

7. The resonator of claim 1, wherein a dielectric constant of the ceramic disc is within a range of 10 to 100, a temperature coefficient of the dielectric constant is within a range of 0 to −100 parts per million per degree Centigrade, and a length of the inner conductive post is less than one quarter wavelength.

8. A resonator, comprising an inner conductive post arranged within a cavity of the resonator with a first end of the inner conductive post in direct electrical contact with an inner surface of the cavity;

a conductive end cap positioned near a second end of the inner conductive post and in electrical contact with the inner conductive post, the inner conductive post and the conductive end cap together forming a line length;

a conductive outer plate forming a boundary of the cavity opposite the conductive end cap; and a ceramic disc arranged in contact with the conductive end cap between the conductive end cap and an inner surface of the conductive outer plate; wherein a resonant frequency of the resonator is determined by at least one of a distance and a pressure between the ceramic disc and the inner surface of the conductive outer plate.

9. The resonator of claim 8, comprising:

a shaft extending through a center axis of the inner conductive post, the conductive end cap, the ceramic disc and the conductive outer plate;

a spring arranged with one end fixed relative to the shaft and the other end pressing the conductive end cap and the ceramic disc toward the conductive outer plate;

at least one tube arranged coaxially with the shaft and between a first end of the shaft and the ceramic disc, the at least one tube locating the ceramic disc and the conductive end cap relative to the first end of the shaft when an air gap exists between the ceramic disc and the inner surface of the conductive outer plate; and an adjustment mechanism arranged to locate the first end of the shaft relative to the conductive outer plate.

10. The resonator of claim 9, wherein thermal expansion of the adjustment mechanism and the at least one tube adjusts an air gap between the ceramic disc and the inner surface of the conductive outer plate to hold constant a resonant frequency of the resonator as a temperature of the resonator varies.

11. The resonator of claim 9, wherein the spring presses the ceramic disc and the conductive end cap against the at least one tube.

12. The resonator of claim 9, wherein the adjustment mechanism comprises an electromagnet and a rigid structure attaching the electromagnet to the conductive outer plate, the electromagnet being arranged to locate the first end of the shaft relative to the conductive outer plate.

13. The resonator of claim 9, wherein the adjustment mechanism comprises a structure attached to the conductive outer plate and having a surface with helical ridges that engage corresponding helical ridges longitudinally fixed in relation to the shaft, so that rotation of the ridges longitudinally fixed in relation to the shaft alters a distance between the first end of the shaft and the conductive outer plate.

14. A resonator, comprising:

a transmission line within a cavity of the resonator, the transmission line having an adjustable length;

a ceramic disc fastened to an end of the transmission line; and means for adjusting a pressure between the ceramic disc and the inner surface of the resonator to maintain the selected resonant frequency of the resonator over varying temperatures of the resonator.

15. The resonator of claim 14, wherein the length of the transmission line is less than a quarter wavelength.

16. The resonator of claim 14, wherein a Q of the ceramic disc is higher than a Q of the transmission line.

17. The resonator of claim 16, wherein a dielectric constant of the ceramic disc is within a range of 10 to 100, and a temperature coefficient of the dielectric constant is within a range of 0 to −100 parts per million per degree Centigrade.

18. A resonator, comprising:

a transmission line within a cavity of the resonator, the transmission line having an adjustable length;

a ceramic disc fastened to an end of the transmission line;

means for adjusting a pressure between the ceramic disc and an inner surface of the resonator opposite the ceramic disc to maintain a selected resonant frequency of the resonator over varying temperatures of the resonator.

19. The resonator of claim 18, wherein the length of the transmission line is less than a quarter wavelength.

20. The resonator of claim 19, wherein a Q of the ceramic disc is higher than a Q of the transmission line.

21. The resonator of claim 20, wherein a dielectric constant of the ceramic disc is within a range of 10 to 100, and a temperature coefficient of the dielectric constant is within a range of 0 to −100 parts per million per degree Centigrade.

22. The resonator of claim 14, wherein the means for adjusting is an electromagnetic coil.

23. The resonator of claim 22, wherein the electromagnetic coil is responsive to control signals.

24. A duplexer comprising:

a receive resonator tuned to a receive frequency comprising:

a receive transmission line within a cavity of the resonator, the transmission line having an adjustable length;

a receive ceramic disc fastened to an end of the transmission line; and means for adjusting a distance between the receive ceramic disc and an inner surface of the receive resonator opposite the receive ceramic disc to maintain a selected resonant frequency of the receive resonator over varying temperatures of the receive resonator; and a transmit resonator tuned to a transmit frequency comprising:

a transmit transmission line within a cavity of the resonator, the transmission line having an adjustable length;

a conductive outer plate forming a boundary of the transmit resonator;

a transmit ceramic disc fastened to an end of the transmit transmission line; and means for adjusting a distance between the transmit ceramic disc and an inner surface of the transmit resonator opposite the ceramic disc to maintain a selected resonant frequency of the transmit resonator over varying temperatures of the resonator, wherein a distance between the transmit ceramic disc and the outer plate determines a capacitance of the transmit resonator.

* * * * *